US006890423B2

(12) United States Patent
O'Rear

(10) Patent No.: US 6,890,423 B2
(45) **Date of Patent: *May 10, 2005**

(54) DISTILLATE FUEL BLENDS FROM FISCHER TROPSCH PRODUCTS WITH IMPROVED SEAL SWELL PROPERTIES

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 407 days.

This patent is subject to a terminal disclaimer.

(21) Appl. No.: 09/999,667

(22) Filed: Oct. 19, 2001

(65) Prior Publication Data

US 2003/0085153 A1 May 8, 2003

(51) Int. Cl.[7] ..... C10G 63/00; C10G 69/02; C10G 35/04; C07C 5/22; C07C 2/04

(52) U.S. Cl. ..... 208/62; 208/64; 208/133; 208/134; 585/470; 585/477; 585/510

(58) Field of Search ..... 208/62, 64, 133, 208/134; 585/470, 477, 510

(56) References Cited

U.S. PATENT DOCUMENTS

| | | | | |
|---|---|---|---|---|
| 3,974,081 | A | 8/1976 | Rutkowski et al. | 252/79 |
| 4,456,527 | A | 6/1984 | Buss et al. | |
| 4,507,517 | A | 3/1985 | Devries et al. | |
| 4,599,474 | A | 7/1986 | Devries et al. | |
| 4,704,487 | A | 11/1987 | Devries et al. | |
| 4,704,493 | A | 11/1987 | Devries et al. | |
| 4,709,108 | A | 11/1987 | Devries et al. | |
| 4,734,537 | A | 3/1988 | Devries et al. | |
| 4,783,566 | A | 11/1988 | Kocal et al. | 585/415 |
| 4,814,533 | A | 3/1989 | Devries et al. | |
| 4,814,534 | A | 3/1989 | Devries et al. | |
| 4,814,538 | A | 3/1989 | Devries et al. | |
| 5,215,548 | A | 6/1993 | Ashcraft et al. | 44/383 |
| 5,282,958 | A | 2/1994 | Santilli et al. | |
| 5,944,858 | A | 8/1999 | Wallace | 44/359 |
| 6,392,109 | B1 * | 5/2002 | O'Rear | 585/323 |
| 6,627,779 | B2 * | 9/2003 | O'Rear | 585/302 |
| 6,776,897 | B2 | 8/2004 | Bacha et al. | |

FOREIGN PATENT DOCUMENTS

| | | |
|---|---|---|
| WO | 01/02325 A1 | 1/2001 |
| WO | 01-64610 A1 | 9/2001 |

OTHER PUBLICATIONS

California Governor's "Diesel Fuel Task Force Final Report," prepared by the Diesel Fuel Task Force, Mar. 29, 1996.

U.S. Appl. No. 10/000,586, filed Oct. 19, 2001, Hemighaus et al., "Thermally Stable Jet Prepared from Highly Paraffinic Distillate Fuel Component and Conventional Distillate Fuel Component.".

United Kingdom Search Report dated Aug. 12, 2004.

U.S. Appl. No. 09/514,958, filed Feb. 29, 2000, Dennis J. O'Rear et al., *Synthesis of Alkylbenzenes and Synlubes from Fischer–Tropsch Products*.

United Kingdom Search Report dated May 13, 2003.

(Continued)

*Primary Examiner*—Walter D. Griffin
*Assistant Examiner*—Tam M. Nguyen
(74) *Attorney, Agent, or Firm*—Burne, Doane, Swecker & Mathis, L.L.P.

(57) ABSTRACT

The invention provides distillate fuel blend components with improved seal swell and lubricity properties obtained from Fischer Tropsch products. The blends contain a highly paraffinic distillate fuel component and distillate-boiling alkylcycloparaffins and/or distillate-boiling alkylaromatics. The invention further provides processes for obtaining such blends using the products of Fischer Tropsch processes. Finally, the invention provides methods for improving seal swell and lubricity properties for distillate fuels.

25 Claims, 3 Drawing Sheets

OTHER PUBLICATIONS

PCT International Search Report mailed Sep. 4, 2003.

Bacha, J.D., et al., *Diesel Fuel Stability and Instability: A Simple Conceptual Model, IASH 2000, the 7th International Conference on Stability and Handling of Liquid Fuels*, Graz, Austria, Sep. 24–29, 2000, pp. 1–7.

Cassidy, W.B., *Fuel Pump Leaks Tied to Low Sulfur: Fuel Prices On the Rise Across Country; O–Ring Failures Seen Following Use of New Fuel, National Newspaper of the Trucking Industry*, Alexandria, VA., Oct. 11, 1993, pp. 1, 22–23.

*E.P.A.'s Diesel Rules Leading to Shortages, Fleet Problems, Price Hikes, Oil Express*, Oct. 11, 1993, p. 4.

Little, D.M., *Catalytic Reforming*, 1985, PennWell Publishing Company, Tulsa, Oklahoma.

Neill, A., *Motorists in Marin Angry Over Fuel Change, New Diesel Mix May Cause Breakdowns, Marin Independent Journal*, Nov. 11, 1993, p A1 & A7.

*New Japanese Processes Promise Cheaper Styrene & Xylenes, Petroleum & Petrochemical International*, Dec. 1972, vol 12, No. 12., pp 64–68.

Pelline, J., *Clean Air, Angry California Drivers, San Francisco Chronicle*, Dec. 23, 1993, pp. A1, A6, Col 1.

Richards, G., *Mechanics Finger New Diesel Fuel, San Jose Mercury News*, Dec. 3, 1993.

Robertson, S.D., et al., *Effect of Automotive Gas Oil Composition on Elastomer Behaviour, SAE Technical Paper Series*, 942018. Fuels & Lubricants Meeting & Exposition, Baltimore, Maryland, Oct. 17–20, 1994, pp. 85–104.

"Standard Test Method for Rubber Property–Durometer Hardness," *ASTM D–2240*, pp. 1–8.

"Standard Test Method for Rubber Property–Effect of Liquids," *ASTM D–471*, pp. 1–13.

"Standard Test Method for Rubber Property–International Hardness," *ASTM D–1415*, pp. 1–10.

"Standard Test Methods for Rubber O–Rings," *ASTM D–1414*, pp. 1–10.

* cited by examiner

DISTILLATE FUEL BLENDS FROM FISCHER TROPSCH PRODUCTS WITH IMPROVED SEAL SWELL PROPERTIES

FIELD OF THE INVENTION

The invention is directed to a distillate fuel blend derived from Fischer Tropsch products which has improved seal swell properties and lubricity.

BACKGROUND OF THE INVENTION

Distillate fuel derived from the Fischer Tropsch process is highly paraffinic and has excellent burning properties and very low sulfur. This makes Fischer Tropsch products ideally suited for fuel use where environmental concerns are important. However, due to their highly paraffinic nature, Fischer Tropsch distillate fuels have problems with poor seal swell properties, and poor lubricity.

The impact of lowering the aromatic content of distillate fuels used as diesel fuel or jet fuel on seal swell in diesel and jet engines is known, and became important when California switched from conventional diesel fuel to Low Aromatics Diesel Fuel (LAD). LAD does not contain zero aromatics, but must contain less than 10%. Literature references to these problems include: Transport Topics, National Newspaper of the Trucking Industry, Alexandria, Va., "Fuel Pump Leaks Tied to Low Sulfur," Oct. 11, 1993; Oil Express, "EPA's diesel rules leading to shortages, fleet problems, price hikes," Oct. 11, 1993, p 4; Marin Independent Journal, "Motorists in Marin angry over fuel change," Nov. 11, 1993, p A1; San Jose Mercury News, "Mechanics finger new diesel fuel," Dec. 3, 1993; and San Francisco Chronicle, "Problems With New Diesel Fuel, Clean Air, Angry California Drivers," Dec. 23, 1993.

The swelling of gaskets can be monitored by the use of known tests. For example, a description of test methodology is presented in SAE Paper No. 942018, "Effect of Automotive Gas Oil Composition on Elastomer Behavior," October 1994, which describes seal swell and hardness changes which were measured in test procedures based as far as possible, on a British Standard (BS) method BS 903 Part A 16 [British Standard Institute, 'Methods for testing vulcanized rubber,' Part A 16:1987—Determination of the effect of liquids], which is broadly similar to American Society for Testing and Materials procedures D 471 [Test Method for Rubber Property-Effect of Liquids] and D 2240 [Test Method for Rubber Property-Durometer Hardness]" (See FIG. 12.) The paper examines volume swelling of five types of elastomers: hydrogenated nitrile, low nitrile, medium nitrile and low nitrile rubbers, and fluorocarbon elastomer.

A summary of work carried out to assess problems associated with California low sulfur/low aromatics fuels is presented in the California Governor's "Diesel Fuel Task Force Final Report," dated Mar. 29, 1996. The report notes results of measurements carried out on O-rings before and after immersion in fuels: volume and weight change by ASTM D 471 [Test Method for Rubber Property-Effect of Liquids], hardness by ASTM D 1415 [Test Method for Rubber Property-International Hardness], and modulus of elasticity, ultimate tensile strength and elongation by ASTM D 1414 [Test Methods for Rubber O-Rings].

Since the transition from conventional distillate fuels to low aromatic fuels created problems with seal swell, greater seal swell problems associated with the transition to a highly paraffinic distillate fuel component made from a Fischer Tropsch process is expected. This may limit the use of Fischer Tropsch distillate fuel.

An additional problem associated with processes that convert Fischer Tropsch products into distillate fuels is that significant quantities of light naphtha are also produced. This light naphtha cannot be blended into most distillate fuels (especially diesel fuel and jet fuel) because it is too volatile. The production of this light naphtha limits the total production of desired distillate fuel. Thus, improvements in the yield of distillate fuel from a Fischer Tropsch process is desired.

There is a need in the art for distillate fuels with acceptable seal swell properties. There is further a need in the art for distillate fuels with satisfactory lubricity properties. Finally, there is a need in the art for distillate fuels with satisfactory properties which can be obtained from Fischer Tropsch process products. This invention provides such distillate fuels and the processes for their manufacture.

SUMMARY OF THE INVENTION

In one aspect of the invention, a distillate fuel blend with improved seal swell properties is provided comprising at least one highly paraffinic distillate fuel component having a branching index of less than 5, and a volume increase of less than about 0.2% when measured according to ASTM D 471 at 23+/−2° C. and for 70 hours when using a nitrile O-ring seal; and at least one component selected from the group consisting of alkylaromatics, alkylcycloparaffins and combinations thereof, wherein the blend exhibits a volume increase of more than about 0.2% when measured according to ASTM D 471 at 23+/−2° C. and for 70 hours when using a nitrile O-ring seal.

In another aspect of the invention, an integrated process for producing a highly paraffinic distillate fuel component, an alkylaromatic distillate fuel component and/or an alkylcycloparaffin distillate fuel component is provided. This process preferably involves the utilization of feedstocks obtained from a Fischer Tropsch process.

An integrated process for preparing a distillate fuel blend with a volume increase of more than about 0.2% when measured according to ASTM D 471 at 23+/−2° C. and for 70 hours when using a nitrile O-ring seal is provided comprising subjecting reformable Fischer Tropsch products to reforming under catalytic reforming conditions to form distillate-boiling alkylaromatics; subjecting distillate-boiling Fischer Tropsch products to isomerization under catalytic isomerizing conditions to form highly paraffinic distillate fuel; and blending the distillate-boiling alkylaromatics and the highly paraffinic distillate fuel to form a distillate fuel blend.

In another aspect of the invention, an integrated process for preparing a distillate fuel blend is provided comprising subjecting light Fischer Tropsch products containing olefins, alcohols or mixtures thereof to alkylation under catalytic alkylation conditions to form an alkylated stream; subjecting the alkylated stream to distillation to obtain distillate-boiling alkylaromatics and reformable Fischer Tropsch products; subjecting the reformable Fischer Tropsch products to reforming under catalytic reforming conditions to form distillate-boiling alkylaromatics; subjecting a portion of the distillate-boiling alkylaromatics obtained from the distillation step to hydrogenation under catalytic hydrogenating conditions to obtain distillate-boiling alkylcycloparaffins; subjecting distillate-boiling Fischer Tropsch products to isomerization under catalytic isomerizing conditions to form highly paraffinic distillate fuel; and blending the distillate-boiling alkylaromatics, the alkylcycloparaffins and the highly paraffinic distillate fuel to form a distillate fuel blend.

In yet another aspect of the invention, a process for improving seal swell properties of a distillate fuel blend is provided comprising blending (a) at least one highly paraffinic distillate fuel component having a branching index of less than 5, and a volume increase of less than about 0.2% when measured according to ASTM D 471 at 23+/−2° C. and for 70 hours when using a nitrile O-ring seal and (b) at least one component selected from the group consisting of alkylaromatics, alkylcycloparaffins and combinations thereof, wherein the resulting blend has a volume increase of more than about 0.2% when measured according to ASTM D 471 at 23+/−2° C. and for 70 hours when using a nitrile O-ring seal.

DETAILED DESCRIPTION OF THE INVENTION

Figure 1:
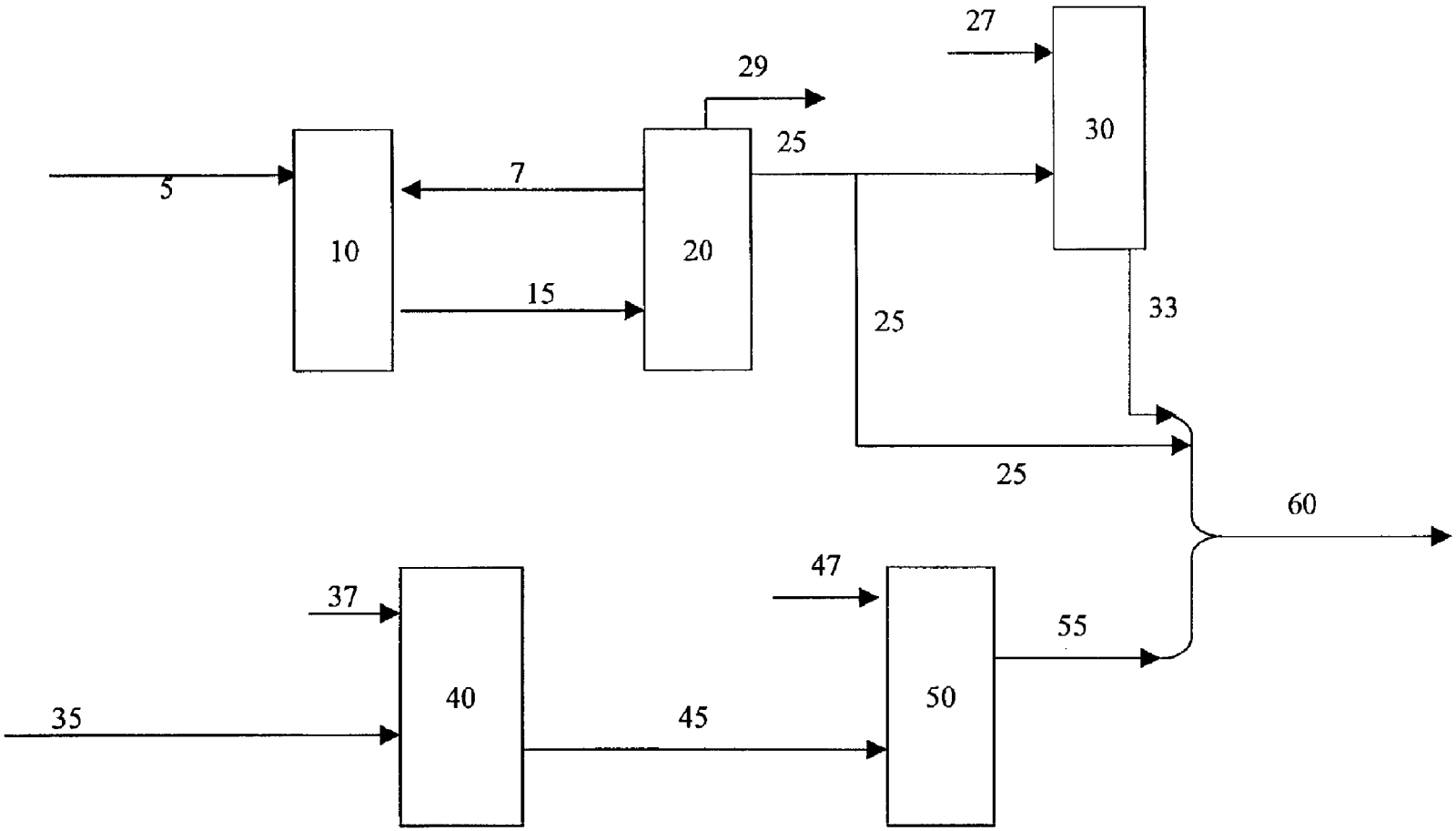
FIG. 1 is an illustration of a process for making alkylaromatics and alkylcycloparaffins from Fischer Tropsch products.

According to the present invention, it has been found that the addition of distillate-boiling alkylaromatics and/or distillate-boiling alkylcycloparaffins to distillate fuels improves the seal swell properties of the fuel, particularly where the distillate fuel is formed from products obtained from the Fischer Tropsch process. Thus, distillate fuel blending components with improved seal swell properties are provided. Improvements in lubricity also are obtained. In one aspect of the invention, distillate fuel blend compositions are provided comprising a highly paraffinic distillate fuel component and a component comprising distillate-boiling alkylaromatics and/or distillate-boiling alkylcycloparaffins. Preferably, the highly paraffinic distillate fuel component and the distillate-boiling alkylaromatics and distillate-boiling alkylcycloparaffins are obtained from products of a Fischer Tropsch process. In another aspect of the invention, processes are disclosed which utilize Fischer Tropsch-derived products to obtain the highly paraffinic distillate fuel component and the distillate-boiling alkylaromatics and alkylcycloparaffins. In one aspect of the invention, light boiling Fischer Tropsch products are converted into distillate fuel, thus increasing the yield of fuel from the Fischer Tropsch process.

For purposes of the present invention, the following definitions will be used herein:

A distillate fuel is a material containing hydrocarbons with boiling points between approximately 60° F. to 1100° F. The term "distillate" means that typical fuels of this type can be generated from vapor overhead streams from distilling petroleum crude. In contrast, residual fuels cannot be generated from vapor overhead streams by distilling petroleum crude, and are then non-vaporizable remaining portion. Within the broad category of distillate fuels are specific fuels that include: naphtha, jet fuel, diesel fuel, kerosene, aviation gas, fuel oil, and blends thereof.

A salable distillate fuel is a distillate fuel meeting the specifications for either naphtha, jet fuel, diesel fuel, kerosene, aviation gas, fuel oil, and blends thereof.

A distillate fuel blend component is a component, which can be used with other components, to form a salable distillate fuel meeting at least one of the specifications for naphtha, jet fuel, diesel fuel, kerosene, aviation gas, fuel oil, and blends thereof, especially diesel fuel or jet fuel, and most especially diesel fuel. The distillate blend fuel component by itself does not need to meet all specifications for the distillate fuel, only the salable distillate fuel needs to meet them. The proportion of distillate fuel blend component in the salable distillate fuel is at least 1%, preferably more than 20%, most preferably more than 75%, and can be as high as 100%. When the distillate fuel blend component is 100% of the salable distillate fuel, it must meet all the specifications for the salable distillate fuel. Distillate fuel blend components can be blended with additives or other fuel components to make a salable distillate fuel.

A diesel fuel is a material suitable for use in diesel engines and conforming to at least one of the following specifications:

ASTM D 975—"Standard Specification for Diesel Fuel Oils"

European Grade CEN 90.

Japanese Fuel Standards JIS K 2204.

The United States National Conference on Weights and Measures (NCWM) 1997 guidelines for premium diesel fuel.

The United States Engine Manufacturers Association recommended guidelines for premium diesel fuel (FQP-1A).

A jet fuel is a material suitable for use in turbine engines for aircraft or other uses meeting at least one of the following specifications:

ASTM D1655.

DEF STAN 91-91/3 (DERD 2494), TURBINE FUEL, AVIATION, KEROSENE TYPE, JET A-1, NATO CODE: F-35.

International Air Transportation Association (IATA) Guidance Materials for Aviation, $4^{th}$ edition, March 2000.

A highly paraffinic distillate fuel component is a distillate fuel component that contains more than 70 wt. % paraffins, preferably more than 80 wt. % paraffins, and most preferably more than 90 wt % paraffins.

A distillate-boiling Fischer Tropsch product is a product derived from a Fischer Tropsch process that boils within 60° F. and 1100° F., preferably boiling between 250 and 700° F. This stream is typically converted to a highly paraffinic distillate fuel component by processes that include an isomerization step.

A light Fisher Tropsch product containing olefins and alcohols is a product derived from a Fischer Tropsch process that contains olefins and/or alcohols and boils between ethylene and 700° F. It preferably boils between propylene and 400° F.

A reformable Fischer Tropsch product is a product derived from a Fischer Tropsch process that can be reformed to aromatics, typically one that boils below 400° F., and preferably one that contains hydrocarbons boiling above n-pentane and below 400° F. Preferably the boiling range of the reformable light fraction is limited to produce single ring aromatics which boil above n-pentane (97° F.) and below n-decane (346° F.). Most preferably, the boiling range is selected to limit the production to benzene, which corresponds to a boiling range above n-hexane and below n-decane.

A heavy Fischer Tropsch product is a product derived from a Fischer Tropsch process that can boil above the range of commonly sold distillate fuels: naphtha, jet or diesel fuel. This means greater than 400° F., preferably greater than 550° F., and most preferably greater than 700° F. This stream is typically converted to a highly paraffinic distillate fuel component by processes that include a hydrocracking step.

Alkylaromatics are compounds that contain at least one aromatic ring with at least one attached alkyl group. This group is composed of alkylbenzenes, alkylnaphthalenes, alkyltetralines, alkylpolynuclear aromatics. Of these, alkylbenzenes are the preferred alkylaromatic.

A distillate-boiling alkylaromatic is an alkylaromatic that when blended with a highly paraffinic distillate fuel component results in a blend that has an acceptable flash point as determined by distillate fuel specifications.

Alkylcycloparaffins are compounds that contain at least one cycloparaffinic ring (typically a C6 or C5 ring, preferably a C6 ring) with at least one attached alkyl group. This group is composed of alkylcyclohexanes, alkylcyclopentanes, alkyldicycloparaffins, and alkylpolycycloparaffins. Of these, alkylcyclohexanes and alkylcyclopentanes are preferred, with alkylcyclohexanes especially preferred.

A distillate-boiling alkylcycloparaffin is an alkylcycloparaffin that when blended with a highly paraffinic distillate fuel component results in a blend that has an acceptable flash point as determined by distillate fuel specifications.

Syngas is a mixture that includes both hydrogen and carbon monoxide. In addition to these species, water, carbon dioxide, unconverted light hydrocarbon feedstock and various impurities may also be present.

A branching index means a numerical index for measuring the average number of side chains attached to a main chain of a compound. For example, a compound that has a branching index of two means a compound having a straight chain main chain with an average of approximately two side chains attached thereto. The branching index of a product of the present invention may be determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D2889 may be used to determine vapor pressure. Alternatively, molecular weight may be determined from a ASTM D-2887 or ASTM D-86 distillation by correlations which compare the boiling points of known n-paraffin standards.

The fraction of carbon atoms contributing to each branching type is based on the methyl resonances in the carbon NMR spectrum and uses a determination or estimation of the number of carbons per molecule. The area counts per carbon is determined by dividing the total carbon area by the number of carbons per molecule. Defining the area counts per carbon as "A", the contribution for the individual branching types is as follows, where each of the areas is divided by area A:

2–branches=half the area of methyls at 22.5 ppm/A

3–branches=either the area of 19.1 ppm or the area at 11.4 ppm (but not both)/A

4–branches=area of double peaks near 14.0 ppm/A

4+branches=area of 19.6 ppm/A minus the 4–branches internal ethyl branches=area of 10.8 ppm/A.

The total branches per molecule (i.e. the branching index) is the sum of areas above.

For this determination, the NMR spectrum is acquired under the following quantitative conditions: 45 degree pulse every 10.8 seconds, decoupler gated on during 0.8 sec acquisition. A decoupler duty cycle of 7.4% has been found to be low enough to keep unequal Overhauser effects from making a difference in resonance intensity.

In a specific example, the molecular weight of a Fischer Tropsch Diesel Fuel sample, based on the 50% point of 478° F. and the API gravity of 52.3, was calculated to be 240. For a paraffin with a chemical formula CnH2n+2, this molecular weight corresponds to an average number n of 17.

The NMR spectrum acquired as described above had the following characteristic areas:

2–branches=half the area of methyl at 22.5 ppm/A=0.30

3–branches=area of 19.1 ppm or 11.4 ppm not both/A=0.28

4–branches=area of double peaks near 14.0 ppm/A=0.32

4+branches=area of 19.6 ppm/A minus the 4–branches=0.14 internal ethyl branches=area of 10.8 ppm/A=0.21

The branching index of this sample was found to be 1.25.

The term "integrated process" refers to a process comprising a sequence of steps, some of which may be parallel to other steps in the process, but which are interrelated or somehow dependent upon either earlier or later steps in the total process.

A Buna N seal is an O-ring made from nitrile elastomer. Other suitable nitrile O-rings for this test can be obtained from a number of sources. American United, compound C-70 is one source. Parker Seals provides three types of O-rings, of which the standard nitrile (N674) is suitable for simulation of the O-rings in common use in current diesel engines as illustrated in this invention. The three O-rings from Parker Seals are: Standard nitrile, type N674, Fuel-resistant nitrile (high-acrylic acrylonitrile), type N497, and Fluorocarbon, type V747. The fuel-resistant and fluorocarbon O-rings are not representative of gaskets in wide commercial use and should not be used in this invention.

Naphtha is typically the $C_5$ to 400° F. (204° C.) endpoint fraction of available hydrocarbons. The boiling point ranges of the various product fractions recovered in any particular refinery or synthesis process will vary with such factors as the characteristics of the source, local markets, product prices, etc. Reference is made to ASTM D-3699-83 and D-3735 for further details on kerosene and naphtha fuel properties.

Diesel fuel guidelines for fuel lubricity are described in ASTM D975. Work in the area of diesel fuel lubricity is ongoing by several organizations such as the International Organization for Standardization (ISO) and the ASTM Diesel Fuel Lubricity Task Force. These groups include representatives from the fuel injection equipment manufacturers, fuel producers, and additive suppliers. The charge of the ASTM task force has been the recommendation of test methods and a fuel specification for Specification D975. Two test methods were proposed and approved. These are D 6078, a scuffing load ball-on-cylinder lubricity evaluator method, SLBOCLE, and D 6079, a high frequency reciprocating rig method, HFRR. The following guidelines are generally accepted and may be used in the absence of a single test method and a single fuel lubricity value: Fuels having a SLBOCLE lubricity value below 2,000 grams might not prevent excessive wear in injection equipment while fuels with values above 3,100 grams should provide sufficient lubricity in all cases. If HFRR at 60° C. is used, fuels with values above 600 microns might not prevent excessive wear while fuels with values below 450 microns should provide sufficient lubricity in all cases. The reproducibility limits for ASTM D6078 is ±900 grams, and the reproducibility limit for ASTM D6079 is ±80 microns. Thus an increase in the D6078 value of 900 grams or more or a decrease the D6079 value of 80 microns or less demonstrate an absolute improvement in lubricity. However, D6078 increases of 225 grams or D6079 decreases of 20 microns or less provide an acceptable measure of a fuel with improved lubricity provided that the measurements are made on the same equipment and with sufficient number of measurements to provide a statistically valid measurement. Preferably the improved lubricity fuel is one that has an increase in the D6078 value of 450 grams or a decrease in the D6079 value when measured at 60° C. of 40 microns or combinations thereof.

According to the present invention, some, or preferably, all of the fuel blend components of the present invention may be obtained from Fischer Tropsch processes. In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer Tropsch chemistry. Means for removing these contaminants are well known to those of skill in the art. For example, ZnO guardbeds are preferred for removing sulfur impurities. Means for removing other contaminants are well known to those of skill in the art. It also may be desirable to purify the syngas prior to the Fischer Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer Tropsch process, liquid and gaseous hydrocarbons are formed by contacting a synthesis gas comprising a mixture of $H_2$ and CO with a Fischer Tropsch catalyst under suitable temperature and pressure reactive conditions. The Fischer Tropsch reaction is typically conducted at temperatures of about 300 to 700° F. (149 to 371° C.), preferably about from 400 to 550° F. (204 to 228° C.); pressures of about from 10 to 600 psia, (0.7 to 41 bars), preferably 30 to 300 psia, (2 to 21 bars) and catalyst space velocities of from about 100 to about 10,000 cc/g/hr., preferably 300 to 3,000 cc/g/hr.

Examples of conditions for performing Fischer-Tropsch type reactions are well known to those of skill in the art. Suitable conditions are described, for example, in U.S. Pat. Nos. 4,704,487, 4,507,517, 4,599,474, 4,704,493, 4,709,108, 4,734,537, 4,814,533, 4,814,534 and 4,814,538, the contents of each of which are hereby incorporated by reference in their entirety.

The products of the Fischer Tropsch synthesis process may range from $C_1$ to $C_{200+}$ with a majority in the $C_5$–$C_{100+}$ range. The reaction can be conducted in a variety of reactor types; for example, fixed bed reactors containing one or more catalyst beds, slurry reactors, fluidized bed reactors, or a combination of different type reactors. Such reaction processes and reactors are well known and documented in the literature. Slurry Fischer Tropsch process are preferred for the process of the invention.

In general, Fischer-Tropsch catalysts contain a Group VIII transition metal on a metal oxide support. The catalysts may also contain a noble metal promoter(s) and/or crystalline molecular sieves. Certain catalysts are known to provide chain growth probabilities that are relatively low to moderate, and the reaction products include a relatively high proportion of low molecular ($C_{2-8}$) weight olefins and a relatively low proportion of high molecular weight ($C_{30}$+) waxes. Certain other catalysts are known to provide relatively high chain growth probabilities, and the reaction products include a relatively low proportion of low molecular ($C_{2-8}$) weight olefins and a relatively high proportion of high molecular weight ($C_{30}$+) waxes. Such catalysts are well known to those of skill in the art and can be readily obtained and/or prepared. The preferred catalysts of this invention contain either Fe or Co, with Co especially preferred.

The present invention in one aspect provides processes which utilize the various products obtained or obtainable from the Fischer Tropsch reaction. The processes described provide distillate-boiling products which can be used as fuel blend components for a distillate fuel blend which exhibits improved seal swell properties and improved lubricity. For example, in one aspect, the present invention provides a process for making distillate-boiling alkylaromatics by reforming the light boiling range of a Fischer Tropsch process. In another aspect of the invention, light aromatics that boil outside of the range of distillate fuel can be converted to additional distillate-boiling alkylaromatics that boil in the range of distillate fuel by alkylation with olefins and alcohols. The olefins and alcohols used to alkylate the light aromatics can be obtained from other products of the Fischer Tropsch process. In yet another aspect of the invention, the present invention provides for a process for producing distillate-boiling alkylcycloparaffins by hydrogenating distillate-boiling alkylaromatics obtained from a Fischer Tropsch process.

The highly paraffinic distillate fuel component of the invention may be prepared by any of the means known to those in the art. Preferably, the highly paraffinic distillate fuel component of the distillate blends of the invention may be prepared from distillate-boiling Fischer Tropsch products by processes that include hydrocracking, hydroisomerization, oligomerization, isomerization, hydrotreating, hydrogenation, or combinations of these processes. In one embodiment, the highly paraffinic distillate fuel component is prepared using a Fischer Tropsch process, an oligomerization process followed by hydrogenation and combinations thereof. In this embodiment, a stream comprising a Fischer Tropsch product boiling lighter than the desired distillate fuel is fed to an oligomerization zone containing an oligomerization catalyst and is subjected to oligomerization under oligomerization conditions. The resulting oligomerized product is then fed to a hydrogenation zone containing a hydrogenation catalyst and is subjected to hydrogenation under hydrogenating conditions. In this aspect of the invention, the highly paraffinic distillate fuel component may be prepared, for example, by oligomerizing a feedstock of light olefins and/or alcohols, and hydrogenating the resulting oligomers. These light olefins and/or light oxygenates are preferably obtained from a Fischer Tropsch process. Alternatively, the light olefins can be obtained by thermally cracking Fischer Tropsch products, especially non-distillate boiling Fischer Tropsch products.

In another aspect of the invention, the highly paraffinic distillate fuel component may be prepared from heavy Fischer Tropsch products by processes that include hydrocracking, hydrotreating, hydrogenation or combinations of these processes. Such processes are known to those of skill in the art.

Figure 2:
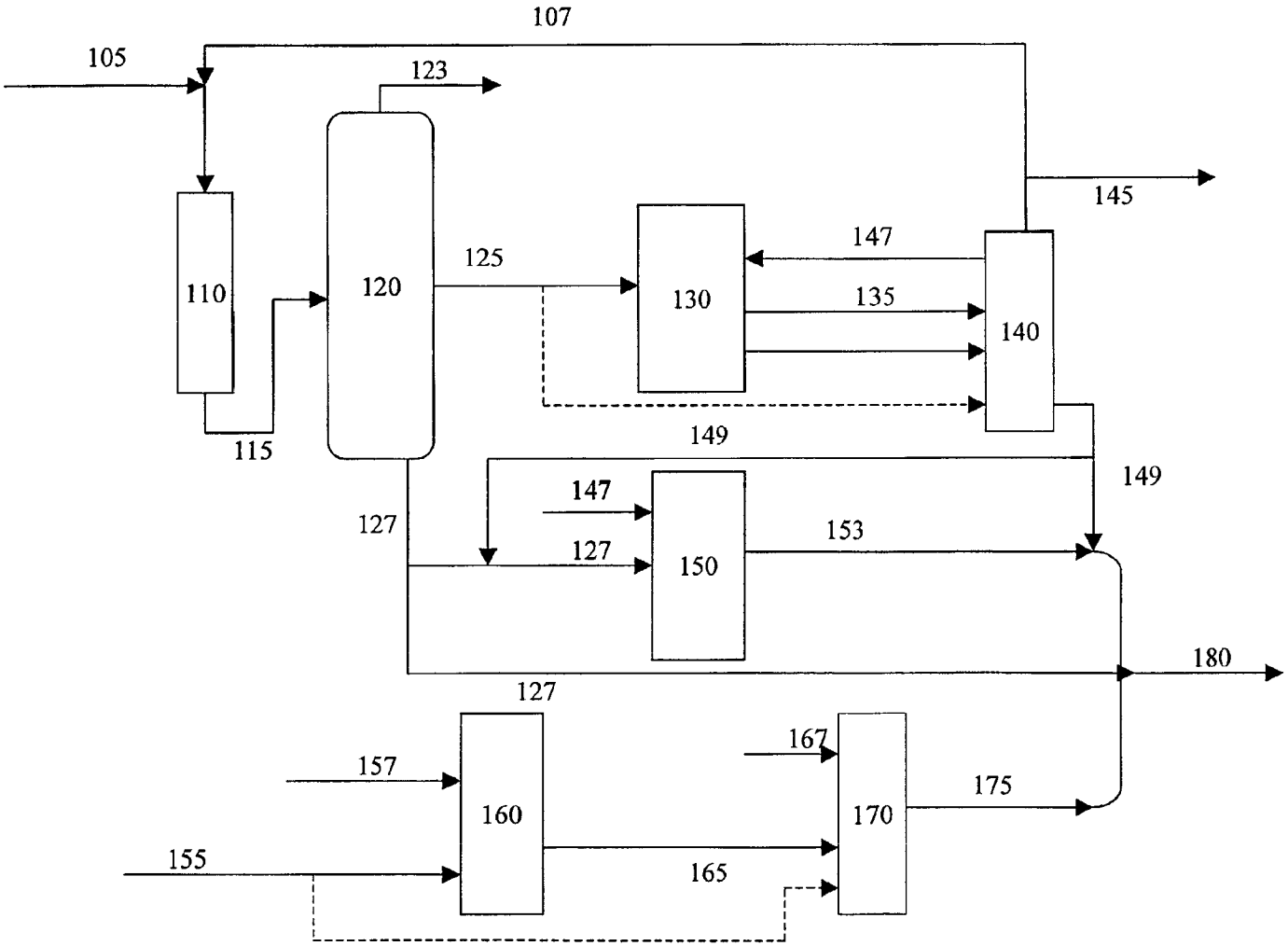
FIG. 2 is an illustration of a process for making alkylaromatics and alkylcycloparaffins from Fischer Tropsch products with additional alkylaromatics generated by alkylation of light aromatics.

FIGS. 1 and 2 illustrate exemplary systems for conducting the processes of the invention using feedstocks from Fischer Tropsch processes to obtain the products desired for the distillate-boiling fuel blend of the invention. In both figures, a distillate fuel blend is prepared through the use of an integrated process, which blend comprises a highly paraffinic distillate fuel component blended with distillate-boiling alkylaromatics and/or distillate-boiling alkylcycloparaffins.

In the aspect of the invention shown in FIG. 1, the highly paraffinic distillate fuel component is prepared by isomerization of a distillate-boiling Fischer Tropsch product. The distillate-boiling Fischer Tropsch products used as a feedstock in this process typically will boil between 60° F. to 1100° F., preferably boiling between 250 and 700° F. The Fischer Tropsch distillate-boiling product is fed to isomerization zone 50 which contains an isomerization catalyst. Hydrogen is added to the isomerization zone and the distillate-boiling Fischer Tropsch product is subjected to isomerization under isomerizing conditions. The isomerization is conducted using conventional isomerization conditions and catalysts. The distillate-boiling Fischer Tropsch product is fed to isomerization zone 50 where isomerization takes place under isomerizing conditions in the presence of hydrogen and a catalyst to produce highly paraffinic distillate fuel. The resulting product of the isomerization zone preferably is a highly paraffinic distillate fuel containing more than about 70 wt. % paraffins, preferably more than 80 wt. % paraffins, and most preferably more than 90 wt. % paraffins.

In one aspect of the invention, isomerization of the distillate-boiling Fischer Tropsch product is done by contacting the product with hydrogen in the presence of a hydroisomerization dewaxing catalyst. The catalyst may be either partial or complete, but is preferably complete. The determination of the class of dewaxing catalyst among conventional hydrodewaxing, partial hydroisomerization dewaxing and complete hydroisomerization dewaxing can be made by using the n-hexadecane isomerization test as described by Santilli et al. in U.S. Pat. No. 5,282,958. When measured at 96% n-hexadecane conversion under conditions described by Santilli et al, conventional hydrodewaxing catalysts will exhibit a selectivity to isomerized hexadecanes of less than 10%, hydroisomerization dewaxing catalysts will exhibit a selectivity to isomerized hexadecanes of greater than or equal to 10%, partial hydroisomerization dewaxing catalysts will exhibit a selectivity to isomerized hexadecanes of greater than 10% to less than 40%, and complete hydroisomerization dewaxing catalysts will exhibit a selectivity to isomerized hexadecanes of greater than or equal to 40%, preferably greater than 60%, and most preferably greater than 80%. Hydroisomerization dewaxing typically uses a dual-functional catalyst consisting of an acidic component and a metal component. Both components generally are required to conduct the isomerization reaction. Typical metal components are platinum or palladium, with platinum most commonly used. The acidic catalyst components useful for partial hydroisomerization dewaxing include amorphous silica aluminas, fluorided alumina, and 12-ring zeolites (such as Beta, Y zeolite, L zeolite), among others.

The conditions for isomerizing the distillate-boiling Fischer Tropsch product typically will be a temperature between 500–800° F. (preferably 600–700° F.), pressures greater than atmospheric (preferably 500–3000 psig), LHSV between 0.25 and 4 (preferably between 0.5 and 2), and H2:oil rates between 200 and 10,000 SCFB (preferably between 1000 and 4000 SCFB). Preferably a fixed bed catalytic reactor is used.

Since the feedstock to the isomerization step may contain olefins and oxygenates which can be poisons for isomerization catalysts, the distillate-boiling Fischer Tropsch product may be hydrotreated prior to isomerization, and the water from the conversion of the oxygenates removed, typically by distillation. In this aspect of the invention, the distillate-boiling Fischer Tropsch stream is fed into a hydrotreating zone 40 and is subjected to hydrotreating. The hydrotreating step is conducted using conventional hydrotreating conditions. Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Catalysts useful in hydrotreating operations are well known in the art. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. The non-noble metal (such as nickel-molybdenum) hydrogenation metals are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalyst may contain in excess of 0.01 percent metal, preferably between 0.1 and 1.0 percent metal. Combinations of noble metals may also be used, such as mixtures of platinum and palladium.

The matrix component may be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica:alumina ratio zeolite Y. Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification. More than one catalyst type may be used in the reactor.

After the highly paraffinic distillate fuel is removed from the isomerization zone, it is fed to a blending zone, not shown, where the highly paraffinic distillate fuel is blended with other distillate fuel components such as alkylaromatics to obtain a distillate fuel blend.

Although not shown in the Figures, the present invention also provides in one aspect the option of preparing the highly paraffinic distillate fuel component heavy Fischer Tropsch products by processes that include hydrocracking. heavy Fischer Tropsch products typically are materials which boil above the range of distillate fuel, typically above about 400° F., preferably greater than about 550° F., and most preferably greater than about 700° F. The hydrocracking may be conducted according to conventional methods known to those of skill in the art. Typically, hydrocracking is a process of breaking longer carbon chain molecules into smaller ones. It may be effected by contacting the particular fraction or combination of fractions, with hydrogen in the presence of a suitable hydrocracking catalyst at temperatures in the range of about from 600 to 900° F. (316 to 482° C.), preferably 650 to 850° F. (343 to 454° C.), and pressures in the range of from about 200 to 4000 psia (13–272 atm), preferably 500 to 3000 psia (34–204 atm) using space velocities based on the hydrocarbon feedstock of about 0.1 to 10 $hr^{-1}$, preferably 0.25 to 5 $hr^{-1}$. Generally, hydrocracking is utilized to reduce the size of the hydrocarbon molecules, hydrogenate olefin bonds, hydrogenate aromatics and remove traces of heteroatoms. Suitable catalysts for hydrocracking operations are known in the art.

In one aspect of the invention, a heavy Fischer Tropsch product obtained from a Fischer Tropsch process may be subjected to hydrocracking over a sulfided catalyst. Preferably, the sulfided catalyst comprises amorphous silica-alumina, alumina, tungsten and nickel. Since the Fischer Tropsch feedstock can contain olefins and oxygenates which can be poisons for hydrocracking catalysts, heavy Fischer Tropsch products may be hydrotreated prior to hydrocracking, and the water from the conversion of the oxygenates removed, typically by distillation.

The distillate-boiling alkylaromatics used in the distillate fuel blend of the invention may be obtained from any source, but are preferably obtained from a reformable Fischer Tropsch product. As shown in the integrated process of FIG. 1, the distillate-boiling alkylaromatics 25 are derived by reforming a reformable Fischer Tropsch product 5 (which has been optionally hydrotreated, in combination with hydrogen 7, in hydrotreating zone 10 to form at least hydrotreated naphtha 15) in reforming zone 20. The reformable Fischer Tropsch product is typically one that boils below 400° F., and preferably one that contains hydrocarbons boiling above n-pentane and below 400° F. Most preferably, the boiling range of the reformable light fraction is limited to produce single ring aromatics which boil above n-pentane (97° F.) and below n-decane (346° F.).

Catalytic reforming or AROMAX® technologies may be used to convert the reformable Fischer Tropsch product or a hydrotreated naphtha to aromatics. Catalytic reforming is well known. For example, it is described in the book, Catalytic Reforming, by D. M. Little, PennWell Books (1985). Further, the AROMAX® Process is well known to those of skill in the art, and is described, for example, in Petroleum & Petrochemical International, Volume 12, No. 12, pages 65 to 68, as well as U.S. Pat. No. 4,456,527 to Buss et al. The reformable Fischer Tropsch product is fed to reforming zone 20 which contains a reforming catalyst. The reformable feed stream is reformed under reforming conditions to produce distillate-boiling alkylaromatics and light by-products. The light by-products typically are hydrocarbons boiling at or below n-pentane. The distillate-boiling alkylaromatics may then be fed or passed to a blending zone where a distillate fuel blend composition may be prepared.

Since Fischer Tropsch products often contain olefins and oxygenates which can be poisons for reforming catalysts, the reformable Fischer Tropsch product may be hydrotreated in hydrotreating zone 10 prior to reforming, and the water from the conversion of the oxygenates removed, typically by distillation, not shown. All or a portion of the distillate-boiling alkylaromatics stream 25 is then fed to a blending zone, not shown, where it is used for the distillate fuel blend 60 by blending the distillate-boiling alkylaromatic fuel component 25 and the highly paraffinic distillate fuel component 55.

All or a portion of the distillate-boiling alkylaromatics stream optionally may be fed to a hydrogenation zone 30 in the presence of hydrogen 27 and subjected to hydrogenation in the presence of a catalyst and under hydrogenating conditions to form distillate-boiling alkylcycloparaffins 33. The portion of distillate-boiling alkylaromatics not hydrogenated and the distillate-boiling alkylcycloparaffins produced then may be blended with the highly paraffinic distillate fuel in a blending zone to form a blended distillate fuel with improved seal swell properties and improved lubricity. The highly paraffinic distillate fuel 55 is derived from a distillate-boiling Fischer-Tropsch product 35, which is optionally hydrotreated in combination with hydrogen 37 within bydrotreating zone 40, and the hydrotreated product 45 is isomerized in combination with hydrogen 47 in isomerization zone 50 to make the highly paraffinic distillate fuel 55.

FIG. 2 illustrates a process for making alkylaromatics and alkylcycloparaffins from Fischer Tropsch products with additional alkylaromatics generated by alkylation of light aromatics. As shown, a distillate-boiling Fischer Tropsch product 155 is utilized as the feedstock in the integrated process to the optional hydrotreating step 160, in combination with hydrogen 157 to obtain stream 165, and the isomerization step 170, in combination with hydrogen 167, which results in the production of highly paraffinic distillate fuel 175 as described above for FIG. 1. FIG. 2 also shows an aspect of the invention wherein distillate-boiling alkylaromatics 149 are prepared by alkylation 110 of light aromatics 107 with light Fischer-Tropsch products containing olefins and/or alcohols 105. Light aromatics refer to aromatic-containing streams that have a relatively light boiling range such that they cannot be blended into the distillate fuel without causing the fuel's flash point to drop below the specification minimum. The actual composition and boiling range of the light aromatics will depend on the specific distillate fuel (jet or diesel). Typically, the light aromatics are streams that contain benzene, toluene, and xylenes, with a total aromatic content of >30 wt %, preferably >60 wt %, and most preferably >80 wt %. Since benzene has health concerns, and xylenes have valuable uses as petrochemical feedstocks, the preferred light aromatic stream contains toluene at greater than 30 wt %, preferably greater than 60 wt %, and most preferably greater than 80 wt %.

The olefins may be formed, for example, by a thermal cracking process on a feedstock obtained from conventional or Fischer Tropsch processes. Where the feedstock to the thermal cracking process is derived from a Fischer Tropsch product, it preferably may be a heavy Fischer Tropsch product. The olefins and alcohols preferably are derived from the Fischer Tropsch process. This serves two benefits. First it removes them from the feedstock that would be reformed which reduces the amount of potential reforming catalyst poisons in this stream. Second, it provides a method of converting light fractions that would not normally be in the distillate fuel boiling range into the distillate fuel boiling range. The light Fischer Tropsch products containing olefins and/or alcohols may be alkylated in alkylation zone 110 and the alkylation products 115 separated, typically by distillation in distillation zone 120. The alkylation and distillation steps may be performed by conventional methods using conventional parameters known to those of skill in the art to produce light by-products, distillate-boiling alkylaromatics and a reformable Fischer Tropsch product.

Typically, and in all practical forms of aromatic alkylation, some form of an acid catalyst is used. These may be of any number of types from bulk acids (sulfuric, hydrofluoric), solid acids (zeolites, acid clays, and/or silica-alumina), and more recently ionic liquids. The conditions for the alkylation depend on the specific nature of the acid, aromatic, and the olefin and/or alcohol. Typically with hydrofluoric acid or ionic liquids, the temperature will be between room temperature and about 75° C. With solid acid catalysts (zeolites and acid clays) the temperature will be between 100 and 300° C., preferably between 150 and 200° C. When alcohols are in the feedstock, they will form water as a by-product from the reaction. In this case the use of solid acid catalysts is preferred since liquid acid catalysts would eventually become diluted with the water product from the reaction. The molar ratio of aromatics to olefin and/or alcohols may be between 0.2 and 20. To avoid oligomerization of the olefins and/or alcohol, preferably the molar ratio of the aromatic to olefins and/or alcohol is greater than 1, and most preferably between 2 and 15. Pressures typically are sufficiently high to maintain the mixture in the liquid phase. The reaction is exothermic, and typically it is done in stages with heat removed in between the stages. The reactors can be either CSTR-type (preferably for liquid acids), ebulating bed, or fixed bed (preferably for solid catalysts). Such processes for alkylating aromatics are known in the art.

The preferred method for this invention is the use of a solid acid catalyst in a fixed bed reactor with stages that permits intermediate heat removal. The molar ratio of aromatic to olefins and/or alcohol preferably is between 4 and 12. The average reactor temperatures preferably are between 150 and 200° C.

Light by-products 123, typically hydrocarbons boiling at or below n-pentane, are removed from the distillation zone 120, and the distillate-boiling alkylaromatics 127 produced may be fed to a blending zone for use in a distillate fuel blend 180. The remaining reformable Fischer Tropsch product 125 is fed to reforming zone 140 for reforming. Optionally, the reformable Fischer Tropsch product may be fed to a hydrotreating zone 130, in combination with hydrogen 147, and hydrotreated to remove unwanted chemical species. After subjecting the reformable Fischer Tropsch product 125 or hydrotreated stream 135 to reforming in reforming zone 140, the product streams from the reforming zone will include a light aromatic stream 107 which may be recycled to the alkylation zone 110, a stream of aromatics for sale or other uses 145 and a distillate-boiling alkylaromatics stream 149. The distillate-boiling alkylaromatics 149 from the reforming zone 140 preferably may then be passed to a blending zone and used for the distillate fuel blend 180.

In one aspect of the invention shown in FIG. 2, all or a portion of the alkylaromatics produced in separation/distillation zone 120 or reforming zone 140 may be fed to hydrogenation zone 150, in combination with hydrogen 147 and hydrogenated to form alkylcycloparaffins in hydrogenation zone 150. The conditions of hydrogenation are well known in the industry and include reacting the alkylaromatic with hydrogen and a catalyst at temperatures above ambient and pressures greater than atmospheric. Preferable conditions for the hydrogenation include a temperature between 300 and 800° F., most preferably between 400 and 600° F., a pressure between 50 and 2000 psig, most preferably between 100 and 500 psig, a liquid hourly space velocity (LHSV) between 0.2 and 10, most preferably between 1.0 and 3.0, and a gas rate between 500 and 10,000 SCFB, most preferably between 1000 and 5000 SCFB.

The catalysts for use in hydrogenation zone 150 (or hydrogenation zone 30 in FIG. 1) are those typically used in hydrotreating, but non-sulfided catalysts containing Pt and/or Pd are preferred, and it is preferred to disperse the Pt and/or Pd on a support, such as alumina, silica, silica alumina, or carbon. The preferred support is alumina. Hydrogen for the hydrogenation can be supplied from the reforming zone 140, or from the synthesis gas used to produce the Fischer Tropsch product, or from steam reforming of methane-containing steams.

The distillate-boiling alkylcycloparaffins produced in hydrogenation zone 150 may then be utilized in a distillate fuel blend with other products from the process of FIG. 2, such as distillate-boiling alkylaromatics produced in reforming zone 140 or distillation zone 120 and highly paraffinic distillate fuel 175 obtained from isomerization zone 170. The blending of these components may be conducted by any of the methods known to those of skill in the art.

The distillate fuel blends of the present invention which may be produced using Fischer Tropsch products as described have been found to have improved seal swell properties. These blended distillate fuels have also been found to have improved lubricity. The distillate fuel blends of the invention generally comprise at least one highly paraffinic distillate fuel component and at least one component selected from the group consisting of alkylaromatics, alkylcycloparaffins and combinations thereof.

The highly paraffinic distillate fuel component generally will have a branching index of less than about 5, preferably less than about 4 and most preferably less than about 3. The highly paraffinic distillate fuel component also generally will have a volume increase of less than about 0.2% when measured according to ASTM D 471 at 23+/−2° C. and for 70 hours when using a nitrile O-ring seal. In one aspect of the invention, the volume increase of the highly paraffinic distillate fuel will be less than about 0.5% when measured according to ASTM D 471 at 23+/−2° C. and for 70 hours when using a nitrile O-ring seal such as a Buna N Seal. ASTM D 471 is the test method which covers the required procedures to evaluate the comparative ability of rubber and rubber-like compositions to withstand the effect of liquids. It is designed for testing specimens of vulcanized rubber cut from standard sheets, specimens cut from fabric coated with vulcanized rubber or finished articles of commerce. ASTM D 471 provides procedures for exposing test specimens to the influence of liquids under definite conditions of temperature and time. The resulting deterioration is determined by measuring the changes in mass, volume, and dimension, before and after immersion in the test liquid. The test is particularly used for certain rubber articles, such as seals, gaskets, hoses, diaphragms, and sleeves which may be exposed to oils, greases, fuels, and other fluids during service. One of skill in the art could readily evaluate a distillate fuel blend using ASTM D 471 to determine the volume change of a seal or gasket.

Typically, the highly paraffinic distillate fuel component will contain more than about 70 weight % of paraffins.

Preferably, the highly paraffinic distillate fuel component will contain more than about 80 weight % paraffins and most preferably more than about 90 weight % paraffins.

The distillate-boiling alkylaromatics useful in the blends of the invention typically will include alkylbenzenes, alkylnaphthalenes, alkyltetralines, or alkylpolynuclear aromatics. Preferably, the distillate-boiling alkylaromatics will comprise alkylbenzenes. Additionally, in one aspect of the invention, these alkylaromatics will have low sulfur and nitrogen contents, for example, less than 100 ppm, preferably less than 10 ppm, and most preferably less than 1 ppm.

The distillate-boiling alkylcycloparaffins useful in the blends of the invention typically will include alkylcyclohexanes, alkylcyclopentanes, alkyldicycloparaffins, alkylpolycycloparaffins and mixtures thereof. Preferably, the distillate-boiling alkylcycloparaffins will include alkylcyclohexanes, alkylcyclopentanes and mixtures thereof. In one aspect of the invention, these alkylcycloparaffins will have low sulfur and nitrogen contents, for example, less than 100 ppm, preferably less than 10 ppm, and most preferably less than 1 ppm.

The distillate fuel blends of the present invention generally will have about 99 wt. % to about 75 wt. % to about 99 wt. % highly paraffinic distillate fuel component and about 1 wt. % to about 25 wt. % alkylaromatics, alkylcycloparaffins, or mixtures thereof. Preferably, the distillate fuel blends of the present invention will have about 80 wt % to about 95 wt % highly paraffinic distillate fuel component and about 5 wt % to about 20 wt % of alkylaromatics, alkylcycloparaffins or mixtures thereof. Generally, where both alkylaromatics and alkylcycloparaffins are added to the fuel blend, the ratio of alkylaromatic to alkylcycloparaffin is 0.25:1.0.

The distillate fuel blend typically will exhibit a volume increase of more than 0.2% when measured according to ASTM D 471 at 23+/−2° C. and for 70 hours when using a nitrile O-ring seal. Preferably the distillate fuel blend will exhibit a volume increase of more than 0.5% when measured according to ASTM D 471 at 23+/−2° C. and for 70 hours when using a nitrile O-ring seal. More preferably, the distillate fuel blend will exhibit a volume increase of more than 1.0% when measured according to ASTM D 471 at 23+/−2° C. and for 70 hours when using a nitrile O-ring seal.

The distillate fuel blends of the invention may include additional components such as antioxidants, dispersants or detergents. In one aspect of the invention, an antioxidant is included in the distillate fuel blend and is selected from the group consisting of an alkylated phenol; or a sulfur-containing component. While sulfur is not desirable from an emissions standpoint, traces of sulfur can improve stability and not make a significant impact on the emissions. The sulfur containing component may be a disulfide, a thiophenol, or a sulfur-containing distillate fuel. Preferably, the sulfur-containing component is a sulfur-containing distillate fuel. Preferably, when a sulfur-containing component is used as the antioxidant, the distillate fuel blend will contain more than about 1 ppm sulfur, and preferably between 1 ppm and 100 ppm sulfur.

In a particularly preferred aspect of the invention, the distillate fuel blends meet the specifications of either a diesel fuel or a jet fuel.

The following examples are given to illustrate the invention and should not be construed to limit the scope of the invention.

EXAMPLES

Example 1

Preparation of Diesel Fuel Samples

A Fischer Tropsch product was generated by reacting synthesis gas over an iron-containing catalyst. The product was separated into a diesel boiling range product (A) and a wax. The diesel product (A) was hydrotreated to remove oxygenates and saturate olefins. The wax was hydrocracked over a sulfided catalyst consisting of amorphous silica-alumina, alumina, tungsten and nickel. A second diesel product (B) was recovered from the effluent of the hydrocracker. The two diesel products were blended in the proportion of 82% B and 18% A by weight. Properties of the Fischer Tropsch (FT) diesel fuel blend are shown in Table 1 along with the ASTM D975 specifications. Table 1A shows the properties of a conventional Low Aromatics Diesel Fuel, and conventional diesel fuel that contains significant quantities of sulfur and aromatics.

TABLE 1

| TESTS | ASTM D975 SPECIFICATIONS | Fischer Tropsch Diesel |
|---|---|---|
| API GRAVITY, 60° F. | | 52.3 |
| SULFUR, ppm | 0.05(% mass max.) | <6 |
| NITROGEN, NG/UL | | 0.69 |
| SFC AROMATICS, WT. % | 35(% vol. max.) | 2.1 |
| CETANE NUMBER ASTM D613 | 40(min.) | 72.3(1) |
| CETANE INDEX ASTM D976 | 40(min.) | 76 |
| SLBOCLE SLC, D6078 g | | 2100 |
| HFRR WSD, mm | | 0.68 |
| BOTD WSD, mm | | 0.65 |
| STANDARD BOCLE WSD, mm | | 0.57 |
| NORMAL/NON-NORMAL PARAFFINS WT. %: | | |
| NORMAL PARAFFINS | | 17.24 |
| NON NORMAL PARAFFINS | | 82.76 |
| DISTILLATION D86, ° F. IBP | | 333 |
| 10% | | 371 |
| 50% | | 478 |
| 90% | 540(min.), 640(max.) | 631 |
| 95% | | 653 |
| EPT | | 670 |

An NMR analysis of the FT diesel indicated that it had an average of 1.25 branches per molecule.

TABLE 1A

Properties of Commercial Diesel Fuels

| DIESEL TYPE: | C | ALAD |
|---|---|---|
| DENSITY @ 15° C., G/ML | 0.8551 | 0.8418 |
| SULFUR, PPM | 4190 | 24 |
| NITROGEN, PPM | 296 | <1 |
| CETANE INDEX (D 976) | 46.4 | 55.0 |
| D 86 DISTILLATION, ° F. | | |
| START | 348 | 366 |
| 5% | 385 | 448 |
| 10% | 404 | 479 |
| 30% | 470 | 535 |
| 50% | 520 | 566 |
| 70% | 568 | 593 |
| 90% | 634 | 632 |
| 95% | 661 | 652 |
| END POINT | 685 | 671 |
| RECOVERY, % | 98.6 | 98.4 |

Example 2

Preparation and Evaluation of Blends of FT Diesel with Alkylaromatics and Alkylcycloparaffins Blends of a light alkylaromatic (cumene) or alkylcycloparaffin (isopropylcyclohexane) with a FT diesel fuel are prepared. The improvement in the seal swell and lubricity are determined along with the decline in cetane index. A preference for alkylaromatics or alkylcycloparaffins can be determined by finding which species gives the greatest improvement in seal swell with the least decline in cetane index. The cetane index in these experiments was determined from a D2887 distillation, converted to D-86 equivalent, molecular weight and density at 20° C. This method provides an acceptable and reproducible measurement of the cetane index.

The seal swell test followed ASTM D471:

O-ring type: o-ring size 2-214 Buna N, vendor McDowell & Co

Test Temperature: ambient 23+/−2° C.

Test Duration: 70 hours

Test sample size: 100 ml

Number of o-rings per sample: three

Results to report: Volume change and hardness change

| | Seal Swell Results | | | |
|---|---|---|---|---|
| Blend | Volume Change | Hardness | Density @ 20° C. | Cetane Index |
| Neat Fischer Tropsch fuel | 0.14 | −6.3 | 0.7662 | 73.4 |
| FT Diesel + 1 wt % cumene | 0.11 | −4.9 | 0.7671 | 72.5 |
| FT Diesel + 5 wt % cumene | 0.84 | −5.5 | 0.7702 | 68.7 |
| FT Diesel + 10 wt % cumene | 2.12 | −6.4 | 0.7742 | 63.0 |
| FT Diesel + 20 wt % cumene | 5.78 | −5.6 | 0.7825 | 53.7 |
| FT Diesel + 1 wt % isopropylcyclohexane | 0.02 | −3.6 | 0.7665 | 72.8 |
| FT Diesel + 5 wt % isopropylcyclohexane | 0.11 | −2.4 | 0.7679 | 69.9 |
| FT Diesel + 10 wt % isopropylcyclohexane | 0.66 | −4.5 | 0.7696 | 65.8 |
| FT Diesel + 20 wt % isopropylcyclohexane | 0.72 | −5.5 | 0.7730 | 59.6 |

Conventional diesel fuels cause seals of this type to expand and over a long time harden. Highly paraffinic fuels cause less of an expansion, and can in fact cause a contraction if the seal had been exposed to a conventional fuel previously. These results show that adding an alkylaromatic or alkylcycloparaffin causes the seal to swell in a fashion similar to conventional fuels. Thus blends of highly paraffinic distillate fuels and alkylaromatics and/or alkylcycloparaffins should exhibit fewer problems with leaking seals in commercial use. During the short term of this test, adding alkylaromatic or alkylcycloparaffin caused no significant change in hardness.

Figure 3:
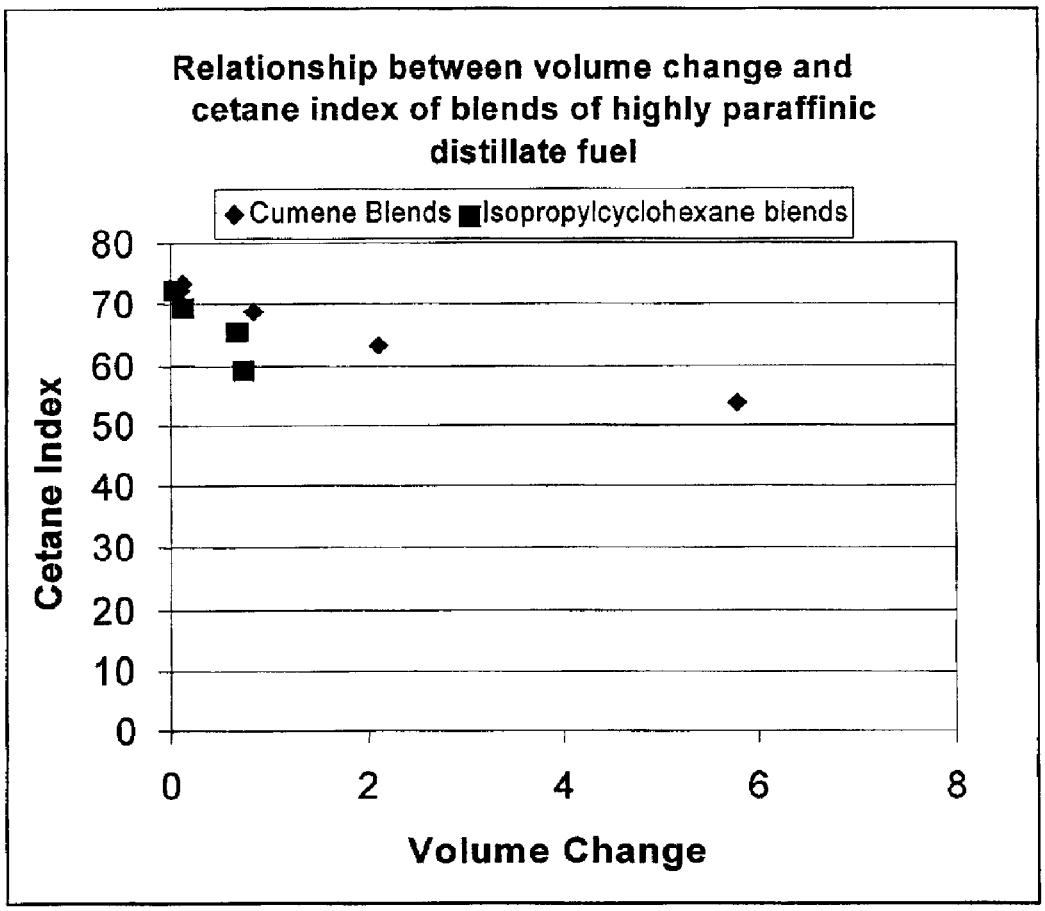
FIG. 3 is a graphical representation of the relationship between volume change and cetane index of blends of highly paraffinic distillate fuel and alkylaromatics or alkylcycloparaffins as described in the examples.

A comparison of blending an alkylaromatic (cumene) with an alkylcycloparaffin (isopropylbenzene) is shown in FIG. 3. Adding an alkylaromatic is preferable to adding an alkylcycloparaffin. A smaller amount of an alkylaromatic is needed to make a given change in volume, and addition of alkylaromatics makes a smaller impact on the cetane number.

While the invention has been described in detail and with reference to specific embodiments thereof, it will be apparent to one skilled in the art that various changes and modifications can be made without departing from the spirit and scope thereof.

What is claimed is:

1. A process for preparing a distillate fuel blend with a volume increase of more than about 0.2% when measured according to ASTM D 471 at 23+/−2° C. and for 70 hours when using a nitrile O-ring seal comprising:

a) subjecting reformable Fischer Tropsch products to reforming under catalytic reforming conditions to form distillate-boiling alkylaromatics;

b) subjecting distillate-boiling Fischer Tropsch products to isomerization under catalytic isomerizing conditions to form highly paraffinic distillate fuel; and c) blending the distillate-boiling alkylaromatics and the highly paraffinic distillate fuel to form a distillate fuel blend.

2. A process according to claim 1 further comprising subjecting a portion of the distillate-boiling alkylaromatics to hydrogenation under catalytic hydrogenating conditions to form distillate-boiling alkylcycloparaffins and blending the resulting alkylcycloparaffins with the distillate-boiling alkylaromatics and the highly paraffinic distillate fuel.

3. A process according to claim 2 wherein the alkylaromatics comprise alkylbenzenes.

4. A process according to claim 3 wherein the alkylbenzenes are subjected to hydrogenation to obtain the alkylcycloparaffins.

5. A process according to claim 1 wherein the alkylaromatics are prepared by alkylating aromatics with a feedstock comprising materials selected from the group consisting of olefins, alcohols and combinations thereof.

6. A process according to claim 5 wherein the feedstock is derived from a Fischer Tropsch process.

7. A process according to claim 1 further comprising subjecting the reformable Fischer Tropsch product to hydrotreatment under catalytic hydrotreating conditions prior to reforming.

8. A process according to claim 5 wherein the olefins are selected from the groups consisting of olefins formed by a thermal cracking process, olefins formed from a thermal cracking process which uses a feed derived from a Fischer Tropsch product and combinations thereof.

9. A process according to claim 8 wherein the thermal cracking process utilizes a heavy Fischer Tropsch product derived from a Fischer Tropsch process.

10. A process according to claim 1 wherein the distillate fuel blend has an improved lubricity according to ASTM D6078 of 225 grams or more.

11. A process for improving seal swell properties of a distillate fuel blend comprising blending (a) at least one highly paraffinic distillate fuel component having a branching index of less than about 5, and a volume increase of less than about 0.2% when measured according to ASTM D 471 at 23+/−2° C. and for 70 hours when using a nitrile O-ring seal and (b) at least one component selected from the group consisting of alkylaromatics, alkylcycloparaffins and combinations thereof, wherein the resulting blend has a volume increase of more than about 0.2% when measured according to ASTM D 471 at 23+/−2° C. and for 70 hours when using a nitrile O-ring seal.

12. A process according to claim 11 wherein the highly paraffinic distillate fuel component is made from one of the group of processes consisting of Fischer Tropsch process, oligomerization followed by hydrogenation, and combinations thereof.

13. A process according to claim 11 wherein the highly paraffinic distillate fuel component is prepared from a Fischer Tropsch product by processes selected from the group consisting of hydrotreating, hydrocracking, hydroisomerization, oligomerization, hydrogenation and combinations thereof.

14. A process according to claim 13 wherein the Fischer Tropsch product is a distillate-boiling product or a heavy Fischer Tropsch product, or combinations thereof and wherein the paraffin content is more than about 90 wt. %.

15. A process according to claim 11 wherein the highly paraffinic distillate fuel has a branching index of less than about 4.

16. A process according to claim 11 wherein the highly paraffinic distillate fuel has a branching index of less than about 3.

17. A process according to claim 11 wherein the distillate fuel blend has an improved lubricity according to ASTM D6078 of 225 grams or more.

18. An integrated process for preparing a distillate fuel blend comprising:

a) subjecting light aromatics to alkylation in the presence of light Fischer Tropsch products containing olefins, alcohols or mixtures thereof under catalytic alkylation conditions to form an alkylated stream;

b) subjecting the alkylated stream to distillation to obtain distillate-boiling alkylaromatics and reformable Fischer Tropsch products;

c) subjecting the reformable Fischer Tropsch products to reforming under catalytic reforming conditions to form distillate-boiling alkylaromatics and light aromatics;

d) subjecting a portion of the distillate-boiling alkylaromatics obtained from the distillation step (b) to hydrogenation under catalytic hydrogenating conditions to obtain distillate-boiling alkylcycloparaffins;

e) subjecting distillate-boiling Fischer Tropsch products to isomerization under catalytic isomerizing conditions to form highly paraffinic distillate fuel; and f) blending the distillate-boiling alkylaromatics selected from the group consisting of distillate-boiling alkylaromatics obtained from the distillation step (b), distillate-boiling alkylaromatics obtained from the reforming step (c), and combinations thereof; the distillate-boiling alkylcycloparaffins; and the highly paraffinic distillate fuel to form a distillate fuel blend.

19. A process according to claim 18 wherein the distillate-boiling alkylaromatics selected from the group consisting of distillate-boiling alkylaromatics obtained from the distillation step (b), distillate-boiling alkylaromatics obtained from the reforming step (c), and combinations thereof comprise alkylbenzenes.

20. A process according to claim 19 further comprising subjecting a portion of the distillate-boiling alkylaromatics obtained from the reforming step (c) to hydrogenation under catalytic hydrogenating conditions to obtain distillate-boiling alkylcycloparaffins.

21. A process according to claim 18 wherein the distillate fuel blend of blending step (f) has a volume increase of more than about 0.2% when measured according to ASTM D 471 at 23+/−2° C. and for 70 hours when using a nitrile O-ring seal.

22. A process according to claim 21 wherein distillate fuel blend of blending step (f) has a volume increase of more than about 0.5% when measured according to ASTM D 471 at 23+/−2° C. and for 70 hours when using a nitrile O-ring seal.

23. A process according to claim 18 further comprising subjecting the reformable Fischer Tropsch product to hydrotreatment under catalytic hydrotreating conditions prior to reforming.

24. A process according to claim 18 further comprising subjecting the highly paraffinic distillate fuel to hydrotreatment under catalytic hydrotreating conditions prior to isomerization.

25. A process according to claim 18 further comprising recycling the light aromatics formed in step (c) to step (a) for use as reactants.

* * * * *